United States Patent [19]

Porreca

[11] 4,209,922

[45] Jul. 1, 1980

[54] ADJUSTABLE AND KNOCK-DOWN PICTURE FRAME CONSTRUCTION

[76] Inventor: Arthur J. Porreca, 233 Cuba Hill Rd., Huntington, N.Y. 11743

[21] Appl. No.: 915,318

[22] Filed: Jun. 14, 1978

[51] Int. Cl.[2] ..... G09F 1/12

[52] U.S. Cl. ..... 40/155; 40/605; 40/606

[58] Field of Search ..... 40/155, 152.1, 152, 40/156, 154, 10 R, 605, 606, 607, 209; 248/466, 441 R; 52/656

[56] References Cited

U.S. PATENT DOCUMENTS

| | | | |
|---|---|---|---|
| 359,316 | 3/1887 | Damlos | 40/152 |
| 729,784 | 6/1903 | Myers | 40/152 |
| 975,094 | 11/1910 | Williams | 40/152 |
| 2,693,959 | 11/1954 | Ross, Jr. | 40/155 X |
| 3,105,316 | 10/1963 | Ison | 40/155 |

FOREIGN PATENT DOCUMENTS

| | | | |
|---|---|---|---|
| 6630 | of 1908 | United Kingdom | 40/155 |

*Primary Examiner*—John F. Pitrelli
*Attorney, Agent, or Firm*—Lackenbach, Lilling & Siegel

[57] ABSTRACT

The frame including a pair of edge engaging members for engagement along opposite edges of a picture, and a pair of clamping assemblies each extending between the pair of edge engaging members in clamping engagement therewith to hold the components in operative condition.

9 Claims, 8 Drawing Figures

FIG. 1
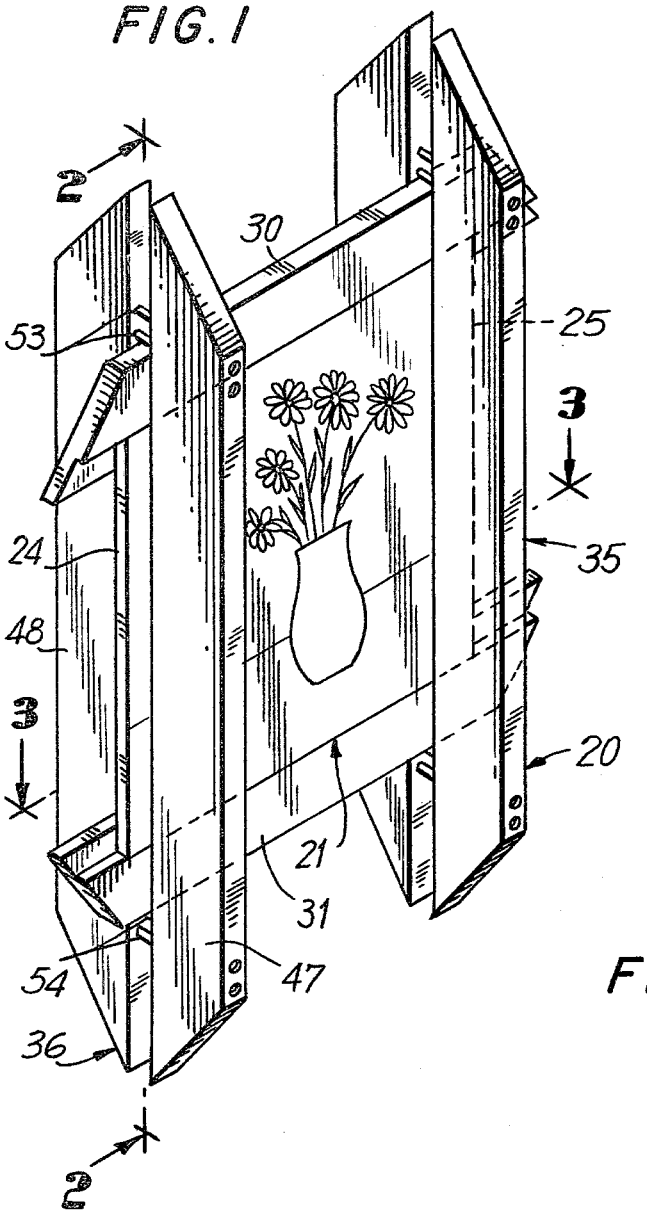
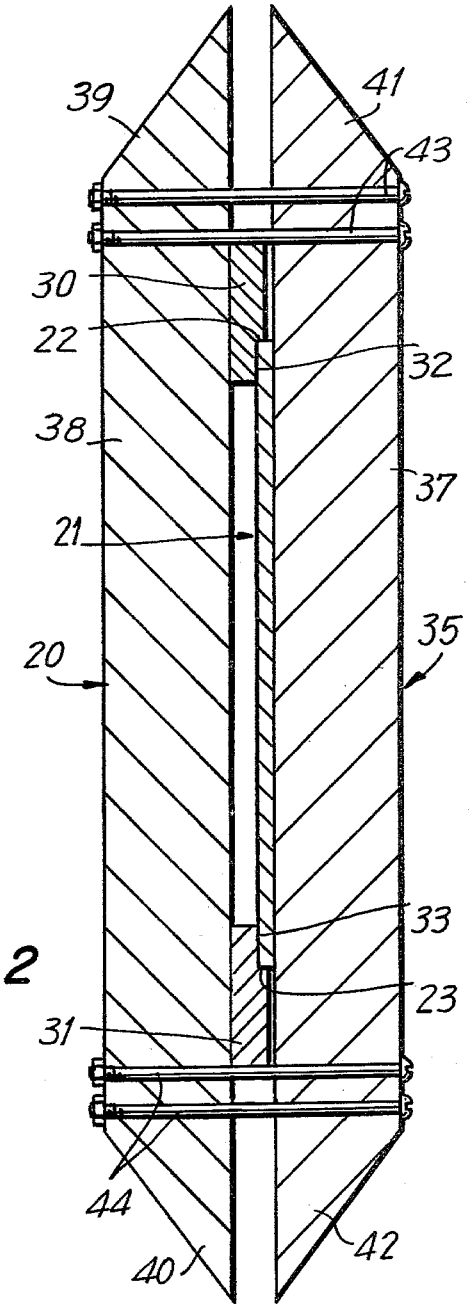
FIG. 2
FIG. 3
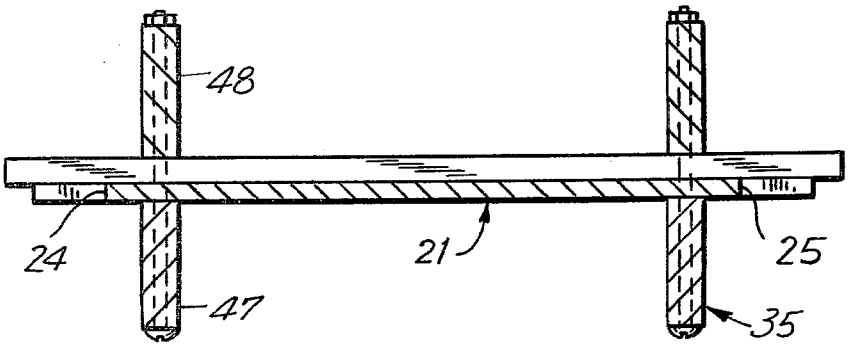

ADJUSTABLE AND KNOCK-DOWN PICTURE FRAME CONSTRUCTION

BACKGROUND OF THE INVENTION

While there have, in the past, been proposed a wide variety of adjustable picture frames, some of which have been of the knock-down variety, such frames have been relatively complex in construction, unduly expensive to manufacture and sell, relatively difficult to assemble with a picture and often lacking in desirable attractiveness and requisite durability. Certain examples of the prior art having these difficulties are U.S. Pat. Nos. 3,988,846; 3,465,461; 3,451,153; 2,869,263 2,866,286; 1,603,796; 1,421,301; 2,790,259 and 2,819,549.

SUMMARY OF THE INVENTION

It is, therefore, an important object of the present invention to provide an adjustable, knock-down picture frame which overcomes the above mentioned problems of the prior art, is extremely simple in structure requiring a minimum of staunch and durable parts, is capable of quick and easy assembly with a picture by persons having only ordinary intelligence and skill, is capable of uniquely attractive aesthetic design and appearance and production and sale at a reasonable cost, and which is highly versatile in use for framing pictures of widely different sizes, as well as being capable of many variations for use in the framing of multiples of pictures in various arrangements.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a top perspective view showing a picture frame of the present invention in operative association with a picture.

FIG. 2 is a sectional elevational view taken generally along the line 2—2 of FIG. 1.

FIG. 3 is a horizontal sectional view taken generally along the line 3—3 of FIG. 1.

DESCRIPTION OF THE PREFERRED EMBODIMENTS

Figure 4:
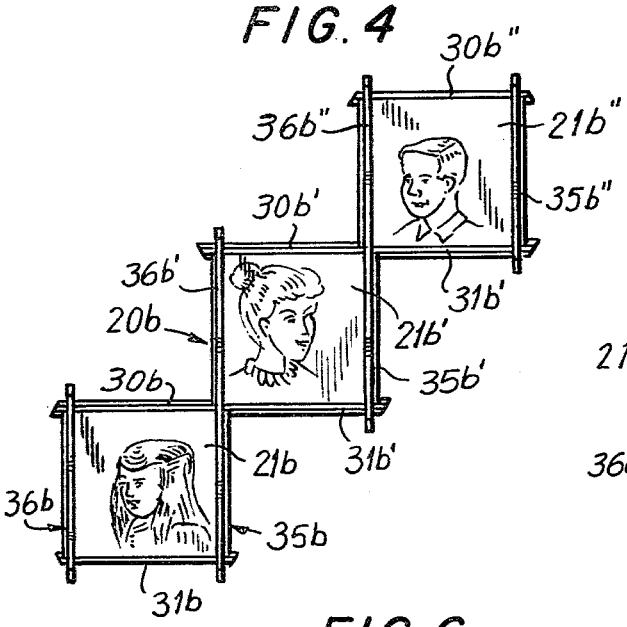
FIGS. 4, 5 and 6 are elevational views showing the present invention employed in framing multiples of pictures in various arrangements.

Referring now more particularly to the drawings, and specifically to FIGS. 1-3 thereof, a picture frame of the present invention is there generally designated 20, and is shown in framing relation with respect to a picture 21.

The picture 21 may be conventional, say of rectangular, generally rigid construction, say a canvas on a stretcher, or any other suitable picture. In the illustrated embodiment, the picture 21 includes generally parallel upper and lower edges 22 and 23, and generally parallel opposite side edges 24 and 25.

Extending along respective upper and lower picture edges 22 and 23 are upper and lower horizontally elongate edge engaging members or frame pieces 30 and 31. The edge engaging members may be of generally rectangular cross-sectional configuration, as seen in FIG. 2. However, each edge engaging member is provided with a longitudinally extending recess or groove, as at 32 and 33, respectively, for receiving upper and lower picture edges 22 and 23. The upper edge engaging member recess 32 faces downwardly and opens laterally or forwardly, for receiving the upper picture edge 22. Further, the horizontal depth of recess or groove 32, as seen in FIG. 2, is less than the thickness of picture 21, so that the picture projects horizontally forwardly beyond the edge engaging member 30, for a purpose appearing presently.

Similarly and conversely the lower picture edge engaging member 31 has its longitudinal recess or groove 33 face upwardly and opening laterally or horizontally forwardly for receiving the lower picture edge 23. Similarly, the horizontal depth of the groove or recess 33 is less than the thickness of picture 21, so that the received lower picture edge 23 projects forwardly beyond the edge engaging member 31.

The hereinbefore described picture 21 and upper and lower picture edge engaging members 30 and 31 are held or clamped in their assembled relationship by a pair of side frame structures or clamping assemblies 35 and 36. The clamping assemblies 35 and 36 are vertically elongate, extending along respective side edges of the picture 21, each clamping assembly extending between and in clamping relation with the upper and lower edge engaging frame members 30 and 31.

More specifically, the clamping assembly 35 includes a pair of elongate front and rear, generally parallel frame members or clamping elements 37 and 38 respectively on the front and rear sides of picture 21 and upper and lower edge engaging members 30 and 31. The rear clamping element 38 extends transversely across and in facing engagement with the rear surfaces of upper and lower edge engaging members 30 and 31, extending upwardly and downwardly beyond the latter, as by clamping element upper and lower end portions 39 and 40. The front or forward clamping element 35, which may be identical to the rear clamping element, if desired, extends generally vertically in front of the assembled picture 21 and upper and lower edge engaging members 30 and 31, and extends upwardly and downwardly therebeyond, as by end portions 41 and 42. As the picture 21 projects forwardly beyond the receiving upper and lower edge engaging members 30 and 31, the clamping element 37 is in facing engagement with the forward surface of picture 21, being spaced from the forward surfaces of edge engaging members 30 and 31, best seen in FIG. 2.

Connecting the front and rear clamping elements 37 and 38 together, at spaced locations adjacent to and outwardly beyond respective edge engaging members 30 and 31, are connecting means, such as tie members or bolts 43 extending between the upper clamping element portions 39 and 41, and 44 extending between the lower clamping element portions 40 and 42. Thus, the tie members or bolts 43 and 44 effectively secure the clamping elements 37 and 38 together in their clamping relation with and maintaining proper assembly of the picture 21 with upper and lower edge engaging members 30 and 31.

The other clamping assembly 36 may extend in laterally spaced generally parallelism with the clamping assembly 35, adjacent to the opposite vertical picture edge 24, and may be of substantially the same construction, if desired. For example, the clamping assembly 36 may include vertically elongate, generally parallel, front and rear frame members or clamping elements 47 and 48, respectively on the front and rear of the assembled picture 21 at upper and lower picture edge engaging members 30 and 31. As described in connection with the clamping assembly 35, the forward clamping element 37 may abut the front surface of picture 21, being spaced from the edge engaging members 30 and 31, while the rear clamping element 38 may abut the rear surfaces of the edge engaging members 30 and 31. Similarly, the clamping elements 47 and 48 may extend upwardly and downwardly beyond the edge engaging members 30 and 31, and have their extending end portions connected together by tie means, such as upper bolts 53 and lower bolts 54. The upper bolts or fasteners 53 may be located adjacent to and above the upper edge engaging member 30, while the lower bolts or fasteners 54 may be located adjacent to and below the lower edge engaging member 31.

While the edge engaging members 30 and 31 have been spaced vertically, and the clamping elements 35 and 36 spaced laterally or horizontally, it is appreciated that the assembly, if desired, be otherwise, say rotated 90° or other, with the edge engaging members spaced generally horizontally and the clamping elements spaced generally vertically. Also, it will be appreciated that the clamping elements 35 and 36 may be spaced closer together or further apart to accommodate pictures of different dimensions in this direction, while the edge engaging members 30 and 31 may be spaced more closely together for smaller pictures, the illustrated condition being a limiting maximum dimension in one direction.

Also, it is now readily understood that disassembly and reassembly is quickly and easily effected, as desired, by mere unscrewing or otherwise undoing of the fastener means 43, 44, 53 and 54, and that the several frame components may be compactly stored or packaged, as for economy and convenience in storage, shipment and handling.

Figure 7:
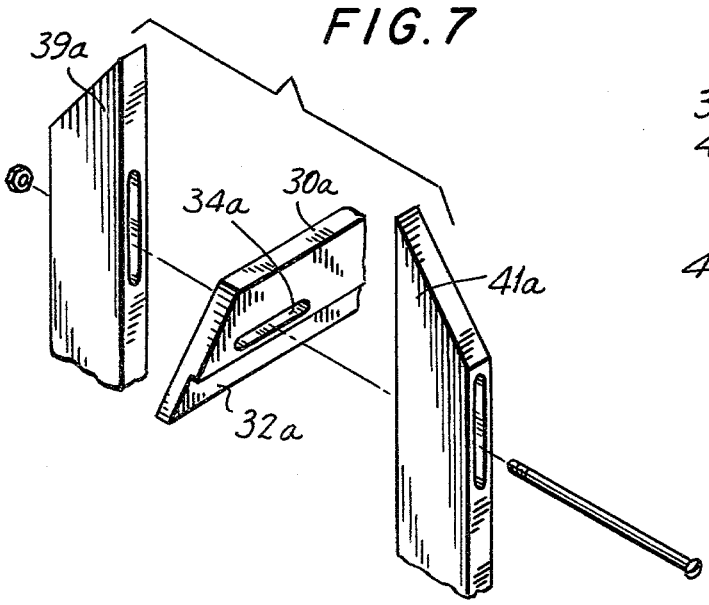
FIG. 7 is a partial exploded view in a perspective similar to that of FIG. 1, but illustrating a slightly modified embodiment.
Figure 8:
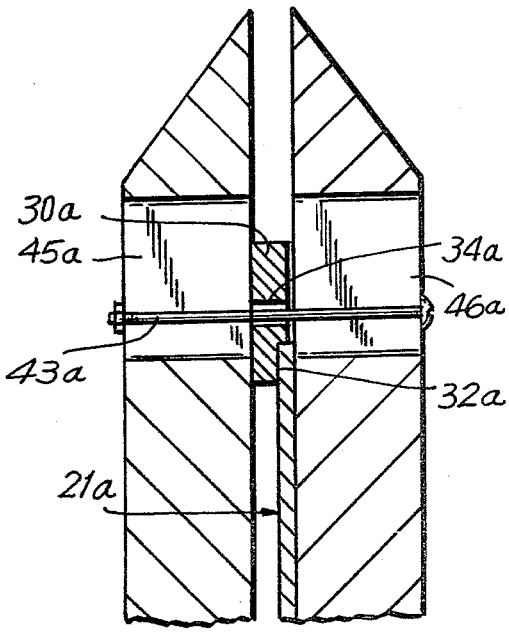
FIG. 8 is a partial sectional elevational view similar to FIG. 2, but showing the modification of FIG. 7.

Referring now to FIGS. 7 and 8, there is shown a slightly modified form of corner construction permitting of limited size adjustability without disassembly of the frame, and also permitting of frame disassembly as desired.

It will there be seen that an upper edge engaging member **30*a* is similar to the edge engaging member 30, including an elongate edge engaging recess or opening 32*a*. However, the edge engaging member 30*a* includes the formation therein of a longitudinally extending, elongate slot 34*a*** opening forwardly and rearwardly through the edge engaging member.

The rear and front clamping elements **39*a* and 41*a*, corresponding to 39 and 41 of the first described embodiment, are disposed in parallelism with each other respectively rearwardly and forwardly of the assembled edge engaging member 30*a* and picture 21*a*. In addition, the clamping elements 39*a* and 41*a* are provided with generally vertically elongate forwardly and rearwardly opening through slots 45*a* and 46*a*, respectively. The slots 45*a* and 46*a* are generally coplanar with each other, and extend generally normal to and intersecting the plane of slot 34*a*. Along the line of such plane intersection, may extend a connecting element, tie member or bolt, 43*a*, which secures the assembly together, in the same manner as tie members 43**.

Of course, the corner construction of FIGS. 7 and 8 may be reproduced at the several frame corners. By such construction, there is a limited degree of adjustability while maintaining the frame components in interconnected or assembled relation.

There is shown in FIG. 4 a multiple picture frame, generally designated **20*b*, which may include a pair of upper and lower edge engaging members 30*b* and 31*b*, in edge engagement with an intermediate picture 21*b*, and associated with clamping assemblies 35*b* and 36*b* in the same manners as described hereinbefore in connection with FIGS. 1–3, 7 and 8. However, upper picture edge engaging member 30*b* may be provided with a longitudinal end extension 31*b*′ suitably configured to define a lower picture edge engaging picture member, and clamping assembly 35*b* may include a vertical upper extension 36*b*′ defining a clamping assembly in association with lower picture edge engaging member 31*b*. Additionally, there may be provided a clamping assembly 35*b*′ upstanding from and in clamping engagement with the extending end portion of lower edge engaging member 31*b*′, and an upper edge engaging member 30*b*′ in the above described operative association with clamping assemblies 36*b*′ and 35*b*′. An additional picture 21*b*′ may be framed in the several frame components 30*b*′, 31*b*′, 35*b*′ and 36*b*′**.

In addition, the upper edge engaging member **30*b*′ may be provided with a longitudinal end extension 31*b*″ defining a lower edge engaging member with respect to still another picture 21*b*″. An upward extension on clamping assembly 35*b*′ may provide another clamping assembly 36*b*″, while an additional upper edge engaging member 30*b*″ and an additional side clamping assembly 35*b*″ may all cooperate in framing relation with respect to the picture 21*b*″**.

From the foregoing, it will be apparent that the frame construction of FIGS. 1–3, 7 and 8 may be extended, as illustrated in FIG. 4 to frame a multiplicity of pictures in a variety of arrangements.

Figure 5:
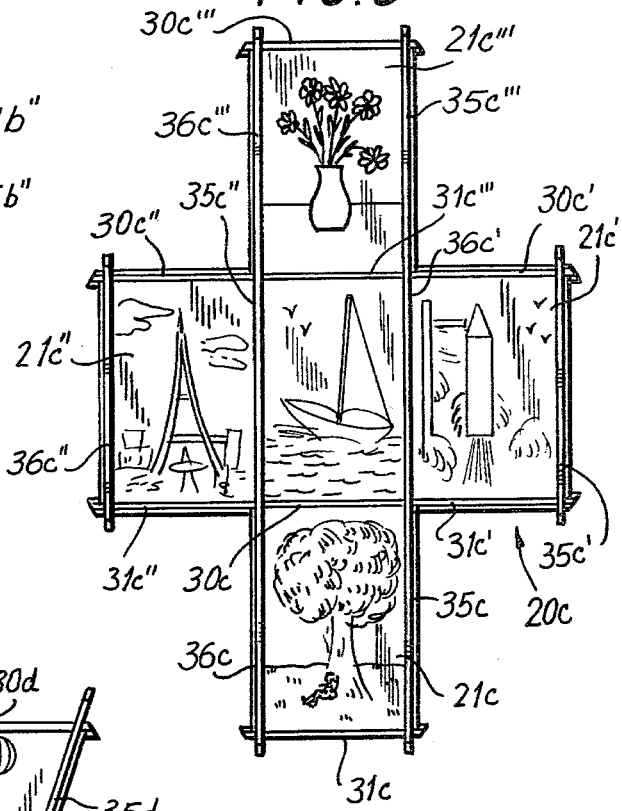

FIG. 5 shows another arrangement wherein a multiple picture frame is generally designated **20*c*, and may include a picture 20*c* bound on its upper and lower edges by upper and lower edge engaging members 30*c* and 31*c*. In addition, right and left clamping assemblies 35*c* and 36*c* may be combined in the general manner described hereinbefore for framing relation with respect to the picture 21*c*. The clamping assembly 35*c* may extend vertically, to define a clamping assembly 36*c*′, while the upper edge engaging member 30*c* may extend endwise to define a lower edge engaging member 31*c*′. An additional upper edge engaging member 30*c*′ may be associated with the clamping assembly 36*c*′ and an additional clamping assembly 35*c*′ may be associated with the lower and upper edge engaging members 31*c*′ and 30*c*′ all suitable assembled to frame the picture 21*c*′**.

Similarly, a picture **21*c*″ may be bounded on one side by an extension of clamping assembly 36*c* defining a clamping assembly 35*c*″, while edge engaging member 30*c* may extend endwise to define a lower edge engaging member 31*c*″. Additionally, along the upper edge of picture 21*c*″ there may extend an upper edge engaging member 30*c*″, and a left side clamping assembly 36*c*″** may extend between the upper and lower picture engaging members 30c'' and 31c''.

Further, a picture 21c''' may be bounded on its lower side by an extension 31c''' between engaging members 30c' and 30c'', while right and left clamping assemblies 35c''' and 36c''' may be defined by extensions of clamping assemblies 36c' *and* 35c'', respectively. In addition, an upper edge engaging member 30c''' may extend between the upper regions of clamping assemblies 35c''' and 36c'''.

It will now therefore be appreciated that an additional picture, as at 21b may be framed within the edge engaging members 30c and 31c''', and the clamping assemblies 36c' and 35c''.

Figure 6:
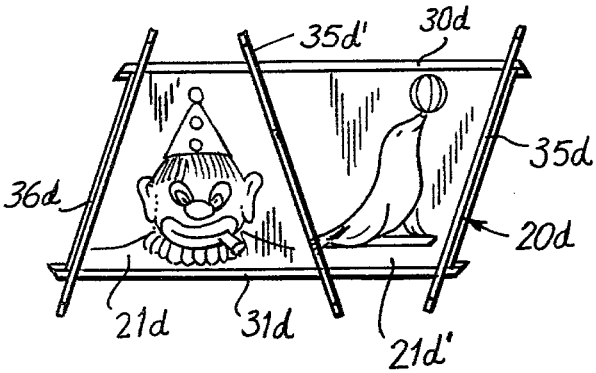

Still another variation is shown in FIG. 6, wherein pictures of other than rectangular configuration are shown as being framed by the construction of the present invention. For example, a pair of lower and upper picture edge engaging members are respectively designated 31d and 30d, while a pair of left and right clamping assemblies are respectively designated 36d and 35d. It will be apparent that the clamping assemblies are not disposed square with respect to the edge engaging members, but rather defining a parallelogram. However, there may be framed within the parallelogram configuration of frame 20d a pair of trapezoidal pictures, if desired, as at 21d and 21d'. Further, an additional intermediate clamping assembly 35d' may extend between and in clamping relation with respect to the upper and lower edge engaging members 30d and 31d, arranged so as to separately frame the pictures 21d and 21d'. However, it is obvious that the frame 20d need not be a parallelogram, but may be trapezoidal, or otherwise, if desired.

From the foregoing, it is seen that the present invention provides a picture frame of the type described which is uniquely adjustable and highly versatile in use, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A picture frame comprising a pair of edge engaging members for engaging along opposite edges of a picture, and a pair of clamping assemblies each extending between said pair of edge engaging members in clamping engagement therewith to hold said members in said edge engagement; said edge engaging members each having a recess for receiving the adjacent picture edge, and said recesses each opening laterally of the associated edge engaging member and being of a depth less than the picture thickness, for picture projection beyond the edge engaging member into clamped engagement with a clamping assembly.

2. A picture frame according to claim 1, said clamping assemblies each comprising a pair of clamping elements respectively extending on opposite sides of said picture and edge engaging members, and connection means releasably connecting together said clamping elements in clamping engagement with the interposed picture and edge engaging members.

3. A picture frame according to claim 2, said connecting means comprising at least a pair of spaced tie members adjacent to respective edge engaging members.

4. A picture frame according to claim 3, said clamping members having elongate openings for passing said tie members and enabling tie member position adjustment within limits of said openings.

5. A picture frame according to claim 3, said edge engaging members having elongate openings for passing said tie members and enabling tie member positioning adjustment within limits of said openings.

6. A picture frame according to claim 1, certain of said edge engaging members and clamping assemblies extending substantially beyond the picture for operative association with an additional picture and additional edge engaging members and clamping assemblies.

7. A picture frame comprising a pair of edge engaging members for engaging along opposite edges of a picture, and a pair of clamping assemblies each extending between said pair of edge engaging members in clamping engagement therewith to hold said members in said edge engagement, said edge engaging members each having a longitudinally extending, laterally opening recess of a depth less than the picture thickness for receiving the latter with the picture projecting beyond the associated edge engaging member into clamping engagement with clamping assemblies, and said clamping assemblies each comprising a pair of clamping elements respectively extending on opposite sides of said picture and said edge engaging members, and connecting means releasably connecting together said clamping elements in clamping engagement with the interposed picture and edge engaging members.

8. A picutre frame according to claim 7, said connecting means comprising at least a pair of spaced tie members adjacent to respective edge engaging members.

9. A picture frame according to claim 8, said clamping members having elongate openings for passing said tie members and permitting tie member position adjustment within the limits of said clamping member openings, and said edge engaging members having elongate openings for passing said tie members and permitting tie member position adjustment within the limits of said edge engaging member openings.

* * * * *